US010912403B2

(12) United States Patent
Stitt et al.

(10) Patent No.: US 10,912,403 B2
(45) Date of Patent: Feb. 9, 2021

(54) UTENSIL HOLDER AND METHOD OF ASSEMBLING THE SAME

(71) Applicants: Sheena Stitt, Woodbridge, VA (US); Tara Marie Stitt, Woodbridge, VA (US)

(72) Inventors: Sheena Stitt, Woodbridge, VA (US); Tara Marie Stitt, Woodbridge, VA (US)

( * ) Notice: Subject to any disclaimer, the term of this patent is extended or adjusted under 35 U.S.C. 154(b) by 119 days.

(21) Appl. No.: 16/281,608

(22) Filed: Feb. 21, 2019

(65) Prior Publication Data

US 2019/0254449 A1 Aug. 22, 2019

Related U.S. Application Data

(60) Provisional application No. 62/633,235, filed on Feb. 21, 2018.

(51) Int. Cl.

| | |
|---|---|
| ***A47G 11/00*** | (2006.01) |
| ***B31D 5/04*** | (2017.01) |
| ***B31D 1/04*** | (2006.01) |
| ***B65B 51/04*** | (2006.01) |

(52) U.S. Cl.

CPC ..... *A47G 11/001* (2013.01); *B31D 1/04* (2013.01); *B31D 5/04* (2013.01); *B65B 51/04* (2013.01)

(58) Field of Classification Search

CPC ..... B31D 1/04; B31D 5/04; A47G 11/001; A47G 11/002

See application file for complete search history.

(56) References Cited

U.S. PATENT DOCUMENTS

| | | | | | |
|---|---|---|---|---|---|
| 1,639,031 | A * | 8/1927 | Groff | A47G 11/001 | 206/494 |
| 1,672,658 | A * | 6/1928 | Shaffer | A47G 11/001 | 206/494 |
| 1,865,922 | A * | 7/1932 | Kowalewski | A47G 11/001 | 206/494 |
| 1,878,437 | A * | 9/1932 | Campbell | B65H 45/101 | 493/357 |
| 2,423,581 | A * | 7/1947 | Clark | A41B 13/10 | 2/48 |
| 3,044,228 | A * | 7/1962 | Peterson | B31D 1/04 | 162/113 |
| 3,392,503 | A * | 7/1968 | Vaughan | B65B 67/08 | 53/461 |

(Continued)

*Primary Examiner* — Hemant Desai
*Assistant Examiner* — Tanzim Imam
(74) *Attorney, Agent, or Firm* — Maier & Maier, PLLC

(57) ABSTRACT

A utensil holder for a table setting and a method of assembling the same may be provided. The utensil holder may include at least one napkin, the napkin being manipulated to form a three-dimensional structure having a cavity; and at least one utensil disposed within the cavity, wherein an outward-facing surface of the three-dimensional structure contains a decorative element. The decorative element may complement a particular theme or decorating motif of a dining occasion. The method of assembling the utensil holder may include a combination of folding techniques that orients one or more napkins into a three-dimensional structure having a cavity for utensils. The utensil holder may be provided with ribbons and other accessories symbolizing various objects.

3 Claims, 7 Drawing Sheets

(56) References Cited

U.S. PATENT DOCUMENTS

| | | | | | |
|---|---|---|---|---|---|
| 4,467,503 | A * | 8/1984 | Boynton | A47G 11/001 | 206/553 |
| 4,938,515 | A * | 7/1990 | Fazio | A41D 13/082 | 2/21 |
| 5,469,688 | A * | 11/1995 | Dunbar | B65B 63/04 | 53/419 |
| 2003/0200591 | A1* | 10/2003 | Hornby | A41D 27/12 | 2/144 |
| 2010/0044271 | A1* | 2/2010 | McMillan | A47G 21/14 | 206/553 |

* cited by examiner

UTENSIL HOLDER AND METHOD OF ASSEMBLING THE SAME

CROSS-REFERENCE TO RELATED APPLICATIONS

This application claims priority to U.S. Provisional Patent Application No. 62/633,235, filed Feb. 21, 2018, the content of which is hereby incorporated by reference in its entirety.

BACKGROUND

A napkin or serviette is generally a piece of absorbent cloth or paper material used to wipe the mouth and protect clothing during a meal. Napkins can be folded into intricate designs and deliberately arranged on a tabletop to enhance the ambiance of a dining room. It is well known to fold napkins into three-dimensional shapes for presentation at a table setting, especially as part of an elegant meal. The fan napkin, for example, is a traditional napkin-folding technique that utilizes a series of narrow, accordion-like folds to create an upright, fanned form. Various napkin creations can add a decorative flair that beautifies and memorializes a dining experience.

Napkins may also serve as tableware articles for storing one or more utensils, such as a knife, spoon, fork, and the like. One such conventional arrangement includes manually wrapping the necessary utensils in a paper napkin and securing said utensils therein with an adhesive paper strap. This practice generally provides a convenient manner of preparing a table setting prior to a meal.

The precise arrangement of tableware often depends on the dining occasion. Celebratory or festive occasions, in particular, tend to involve more elaborate place settings and decorations. It would, therefore, be advantageous to provide a napkin utensil holder capable of customization for a particular dining occasion.

SUMMARY

Accordingly, it is an object of the present invention to provide a customizable utensil holder and method of making the same. The utensil holder may provide sanitary protection for a set of flatware enclosed therein, as well as complementary packaging for a decorative table setting.

According to an exemplary embodiment, a utensil holder for a table setting may be provided herein. The utensil holder may include at least one napkin, the at least one napkin being manipulated in a folding sequence to create a three-dimensional structure having a cavity; and at least one utensil disposed within the cavity, wherein an outward-facing surface of the three-dimensional structure contains a decorative element.

According to another exemplary embodiment, a method of assembling a utensil holder may be described. The method may include the steps of: providing two napkins, each napkin having a perimeter with four sides; overlapping the two napkins in a diagonal direction such that a corner of a top napkin is situated on a center of a bottom napkin, the four sides of the top napkin being arranged substantially parallel with the four sides of the bottom napkin; positioning at least one utensil adjacent a center surface of the overlapped napkins, wherein the at least one utensil has a first end and a second end defining a longitudinal axis; folding a left corner of the top napkin and a left corner of the bottom napkin toward the center of the overlapped napkins; folding a right corner of the top napkin and a right corner of the bottom napkin toward the center of the overlapped napkins; creating an aperture through the folded corners of the overlapped napkins; and threading a fastener through the aperture.

According to another exemplary embodiment, a method of assembling a utensil holder may include: providing a first napkin, a second napkin, and a third napkin, each napkin having a perimeter with four sides and four corners, each corner connecting a pair of adjacent sides; folding a top corner of the first napkin toward a center thereof to form a first fold, wherein the first fold is made to divide the first napkin into a smaller portion and larger portion; positioning at least one utensil adjacent a center surface of the first napkin with the top corner folded underneath, wherein the at least one utensil has a first end and a second end defining a longitudinal axis, the longitudinal axis bisecting the top corner; folding a left corner and a right corner of the first napkin inward and across the at least one utensil thereby creating a triangular cone; folding a top corner of the second napkin and positioning the triangular cone in a center portion thereof with the top corner of the second napkin folded underneath; folding the left corner and the right corner of the second napkin inward and across the triangular cone to create a cape portion; folding the third napkin diagonally in half and positioning the triangular cone with cape portion in a center thereof; and folding and tucking the corners of the third napkin inward and across the triangular cone with cape portion.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
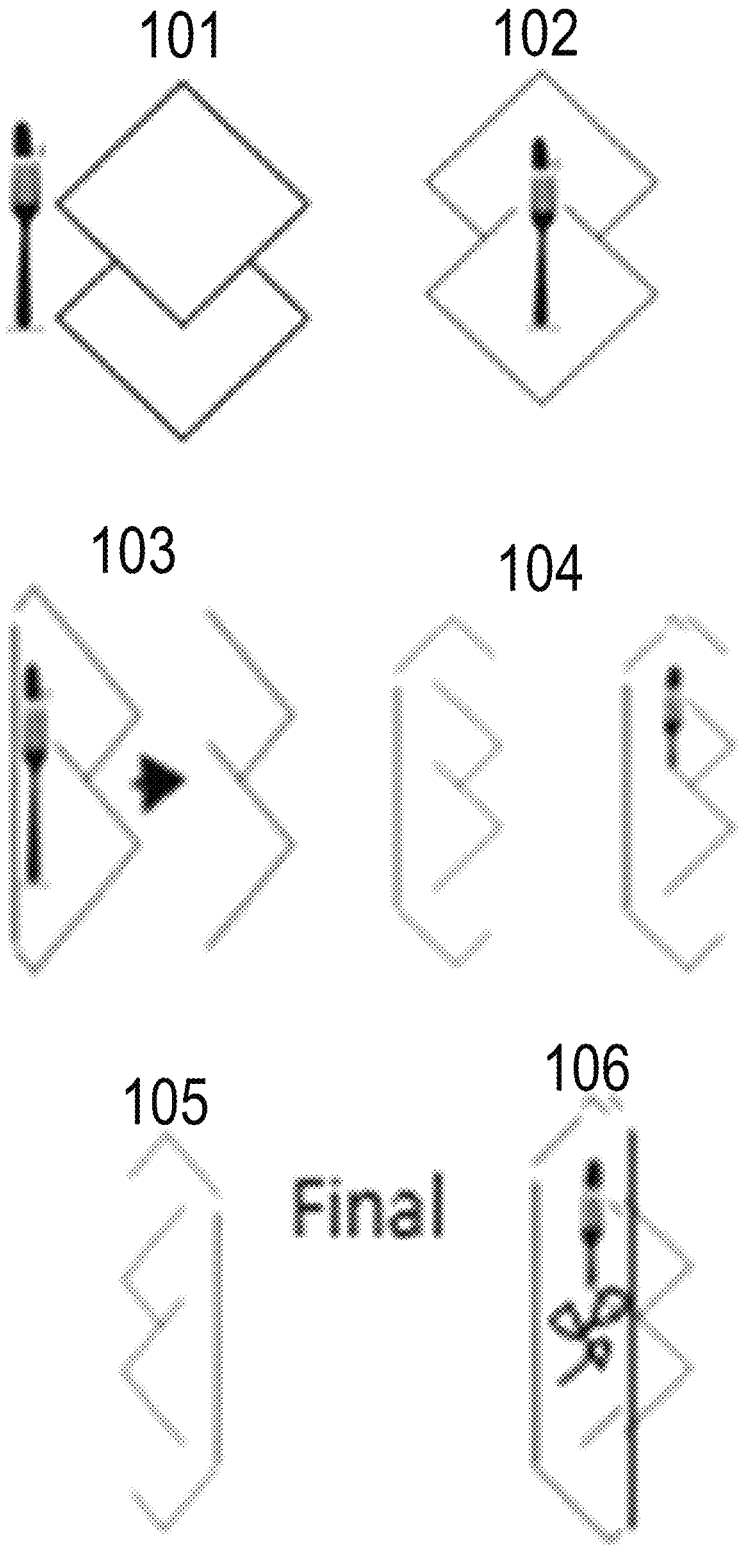
FIG. 1 is a schematic perspective view illustrating a sequence of napkin folds used to assemble an exemplary embodiment of a utensil holder in accordance with the present invention.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage, or mode of operation.

According to an exemplary embodiment, a utensil holder for a decorative table setting may be provided. The utensil holder may be composed of one or more napkins, each napkin being substantially square with a perimeter having four sides and four corners. The napkin may be folded on itself, combined with other napkins, or otherwise manipulated in sequence to create a three-dimensional structure having a cavity. The cavity may be configured to receive one or more utensils, such as a knife, fork, spoon, straw, and/or pair of chopsticks. An outward-facing surface of the three-dimensional structure may contain at least one decorative element, such as a color, pattern, symbol, alphanumeric character, logo, picture, or any other suitable design. A fastener may releasably attach to the three-dimensional structure for securing the napkins and the one or more utensils in place.

The utensil holder may further unfold from an assembled form to reveal the one or utensils enclosed therein. The utensil holder may include single or multiple colored napkins with ribbons, accessories, or decorative attachments symbolizing various objects and special events.

In some exemplary embodiments, a decorative attachment may be disposed on the outward-facing surface of the three-dimensional structure. The decorative attachment may include one or more stickers, buttons, decals, pom-poms, tassels, lighting fixtures, or any other suitable crafting object as would be understood by one of ordinary skill in the art. The decorative attachment may complement a decorative theme for the table setting and may contribute to the utensil holder resembling an actual identifiable object. A fully assembled utensil holder may resemble, for example, an article of clothing or garment (e.g., a graduation gown, martial arts uniform), a flower, a person, a rocket, a horn, a crayon, or a diploma. In other exemplary embodiments, the decorative theme may be provided through complementary colors, patterns, designs, and decorative attachments.

According to another exemplary embodiment, a method of assembling a utensil holder may be provided. The method may include a combination of folding techniques that orients one or more napkins into a three-dimensional structure. The three-dimensional structure may encapsulate one or more utensils and display various colors, patterns, symbols, or other graphical designs on an outward-facing surface thereof. The utensil holder may be customizable to complement decorations for a special occasion, such as a black-tie event, wedding, anniversary, graduation, birthday, religious ceremony, promotional event, retirement party, military event, etc. Such customization may include variation in napkin choice (e.g., material, color, print, and folding sequence), variation in utensil choice (e.g., type, material, color, quantity), variation in decorative element (e.g., type, material, color, quantity), variation in fastening device (e.g., type, material, color), and variation in decorative attachment (e.g., type, material, color, quantity).

Each napkin may be constructed from any suitable material as would be understood by one of ordinary skill in the art. Non-limiting examples of material may be pliable, absorbent or non-permeable natural or synthetic material, and include paper, cellulosic materials, natural or synthetic plastics, natural or synthetic fibers, or any combination thereof. In some exemplary embodiments, the napkin may be constructed from a sheet of woven fabric, such as woven cotton. It should be appreciated, however, that cloth napkins may be woven from fibers/yarns of other types of materials (e.g., polyester, linen, and silk) and/or combinations of different types of materials (e.g., cotton and polyester). The napkin may also incorporate various trims, ribbons, lace, or finished edges. In some exemplary embodiments, the napkin material is machine washable.

The napkins may be sized and shaped in accordance with conventional standards. In some exemplary embodiments, for example, napkins may range from approximately 12-inch to 18-inch squares.

In some exemplary embodiments, napkins may be produced by embossing, stamping, perforating, printing, or otherwise transferring colors, designs or other indicia in spaced patterns on a continuous web of material. Patterns may correspond to a specific napkin-folding sequence, such that a desired design appears on an outward-facing surface of the fully assembled utensil holder. In some exemplary embodiments, napkins may be personalized with names, logos, text, graphics, or any other suitable personalized content.

Each utensil holder may be secured with a fastener, such as a ribbon, tie, lanyard, tape, and the like. The fastener may be available in an assortment of colors to complement a decorative theme.

Utensils may include any type of suitable utensil as would be understood by one of ordinary skill in the art. Such utensils may include, but are not limited to, forks, spoons, knives, serving utensils, straws, chopsticks, spatulas, sporks, ladles, picks, and/or any combination thereof. In some exemplary embodiments, the utensils may be constructed from disposable plastic, and manufactured in clear, non-colored, or colored form. In one exemplary embodiment, for example, the utensils are constructed from BPA-free plastic. In other exemplary embodiments, the utensils may be constructed from reusable materials, such as metals (e.g., stainless steel, silver alloy, pewter), wood, or bamboo. The utensils may be available in a variety of colors to complement a decorative theme.

According to another exemplary embodiment, a set of utensil holders may be provided. The set may include a plurality of specially fabricated utensil holders that share a common ornamentation or decorative theme. Each utensil holder may include one or more napkins folded in a particular pattern or sequence to create a three-dimensional structure having a cavity; one or more utensils disposed within the cavity; and at least one decorative element provided on an outward-facing surface thereof. The utensil holders in the set may be identical, configured substantially similar, or may be different.

In some exemplary embodiments, the set of utensil holders may be disposable, wherein each utensil holder is composed of a paper material with plastic utensils disposed therein. In other exemplary embodiments, the set of utensil holders may be non-disposable, wherein each utensil holder is composed of a cloth material with traditional silverware disposed therein.

Each set may be available as a boxed collection. The number of utensil holders associated with each set is not limited to any particular number, but may include 25, 50, or 75 individual utensil holders.

Consumers may be able to select from a variety of sets designed for a particular occasion, such as a religious celebration, social gathering, corporate function, and the like. In one exemplary embodiment, for example, the set of utensil holders may be designed with a military theme. The military theme may incorporate camouflage patterns, red, white, and blue colors, and napkins fabricated in the shape of wings. In another exemplary embodiment, the set of utensil holders may be designed with a matrimonial theme. The matrimonial theme may incorporate "Just Married" phrasing on the napkin surface, black and white colors, pearl trim, and napkins fabricated in the shape of a dress. In another exemplary embodiment, the set of utensil holders may be designed with a children's theme. The children's theme may include facial expressions printed on the utensils.

Referring now to the figures, FIG. 1 is a schematic perspective view illustrating a sequence of napkin folds used to assemble an exemplary embodiment of a utensil holder in accordance with the present invention. In accordance with the exemplary embodiment, reference numerals may depict: 101: providing two napkins, each napkin having a perimeter with four sides; overlapping the two napkins in a diagonal direction such that a corner of a top napkin is situated on a center of a bottom napkin, the four sides of the top napkin being arranged substantially parallel with the four sides of the bottom napkin; 102: positioning at least one utensil adjacent a center surface of the overlapped napkins, wherein the at least one utensil has a first end and a second end defining a longitudinal axis; 103: folding a bottom corner of the napkins to secure the utensils; 104: folding a left corner of the top napkin and a left corner of the bottom napkin toward the center of the overlapped napkins; 105: folding a right corner of the top napkin and a right corner of the bottom napkin toward the center of the overlapped napkins; 106: creating an aperture in the edge of the folded napkins to secure the utensils; and threading a fastener, such as a ribbon, through the aperture, wherein the ribbon is tied into a bow.

Figure 2:
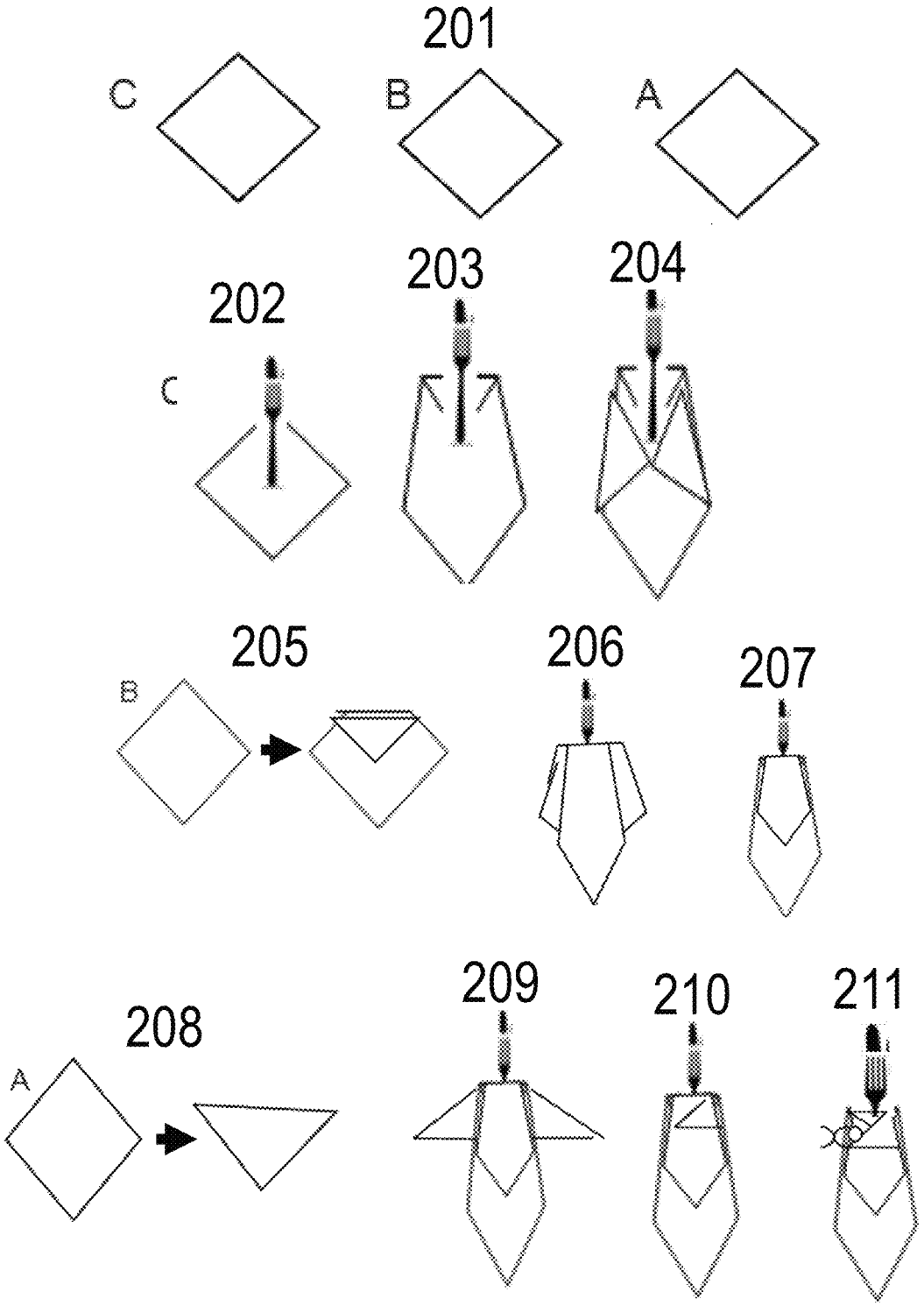
FIG. 2 is a schematic perspective view illustrating a sequence of napkin folds used to assemble another exemplary embodiment of a utensil holder.

Turning now to exemplary FIG. 2, a sequence of napkin folds used to assemble another exemplary embodiment of a utensil holder may be described. In accordance with the exemplary embodiment, reference numbers may depict: 201: providing a first napkin (C), a second napkin (B), and a third napkin (A), each napkin having a perimeter with four sides and four corners, each corner connecting a pair of adjacent sides; and positioning the three napkins (C, B, A) diagonally; 202: positioning at least one utensil adjacent a center surface of the first napkin (C), wherein the utensil has a first end and a second end defining a longitudinal axis; 203: folding a top corner of the first napkin toward a center thereof to form a first fold, wherein the first fold is made to divide the first napkin into a smaller portion and larger portion. The top corner of the first napkin (C) may be folded, for example, a third of the way down the length of the first napkin. 204: folding a left corner and a right corner of the first napkin (C) inward and across the at least one utensil thereby creating a triangular cone; and firmly pressing the creases of each fold; 205: folding a top corner of the second napkin (B); 206: positioning the triangular cone (including the first napkin (C) and the at least one utensil) in a center portion of the second napkin (B) with the top corner folded underneath; 207: folding the left corner and the right corner of the second napkin inward and across the triangular cone, in a cape-like fashion; 208: folding the third napkin (A) diagonally in half; 209: positioning the wrapped triangular cone (including the first napkin (C), the second napkin (B), and the at least one utensil) in a center portion of the third napkin (A) at the neck of the at least one utensil; 210: folding and tucking the right corner and the left corner of the third napkin (A) inward and across the at least one utensil; 211: creating an aperture on an upper right side of the assembled utensil holder; and threading a fastener through the aperture to secure the napkins and utensils in place.

Figure 3:
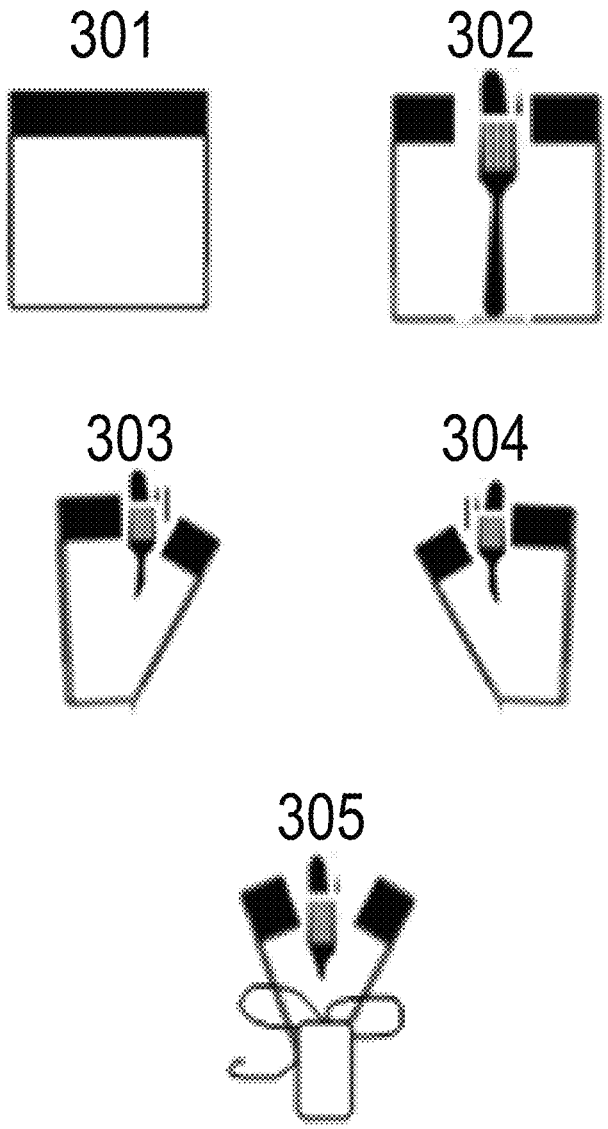
FIG. 3 is a schematic perspective view illustrating a sequence of napkin folds used to assemble another exemplary embodiment of a utensil holder.

Turning now to exemplary FIG. 3, a sequence of napkin folds used to assemble another exemplary embodiment of a utensil holder may be described. In accordance with the exemplary embodiment, reference numerals may depict: 301: providing two napkins, each napkin having a perimeter with four sides, the two napkins being of different color; and overlapping the two napkins with one directly on top of the other with a space from the top to reveal the bottom napkin; 302: positioning at least one utensil adjacent a center surface of the overlapped napkins, wherein the at least one utensil has a first end and a second end defining a longitudinal axis; 303: folding a right side of the napkins diagonally inward on a slant; 304: folding a left side of the napkins diagonally inward on a slant; firmly pressing down on the napkin to crease the folds; and tucking extra material behind the utensils; 305: securing a fastener, such as a ribbon, around the center of the utensils and napkins; and tying the fastener into a bow.

Figure 4:
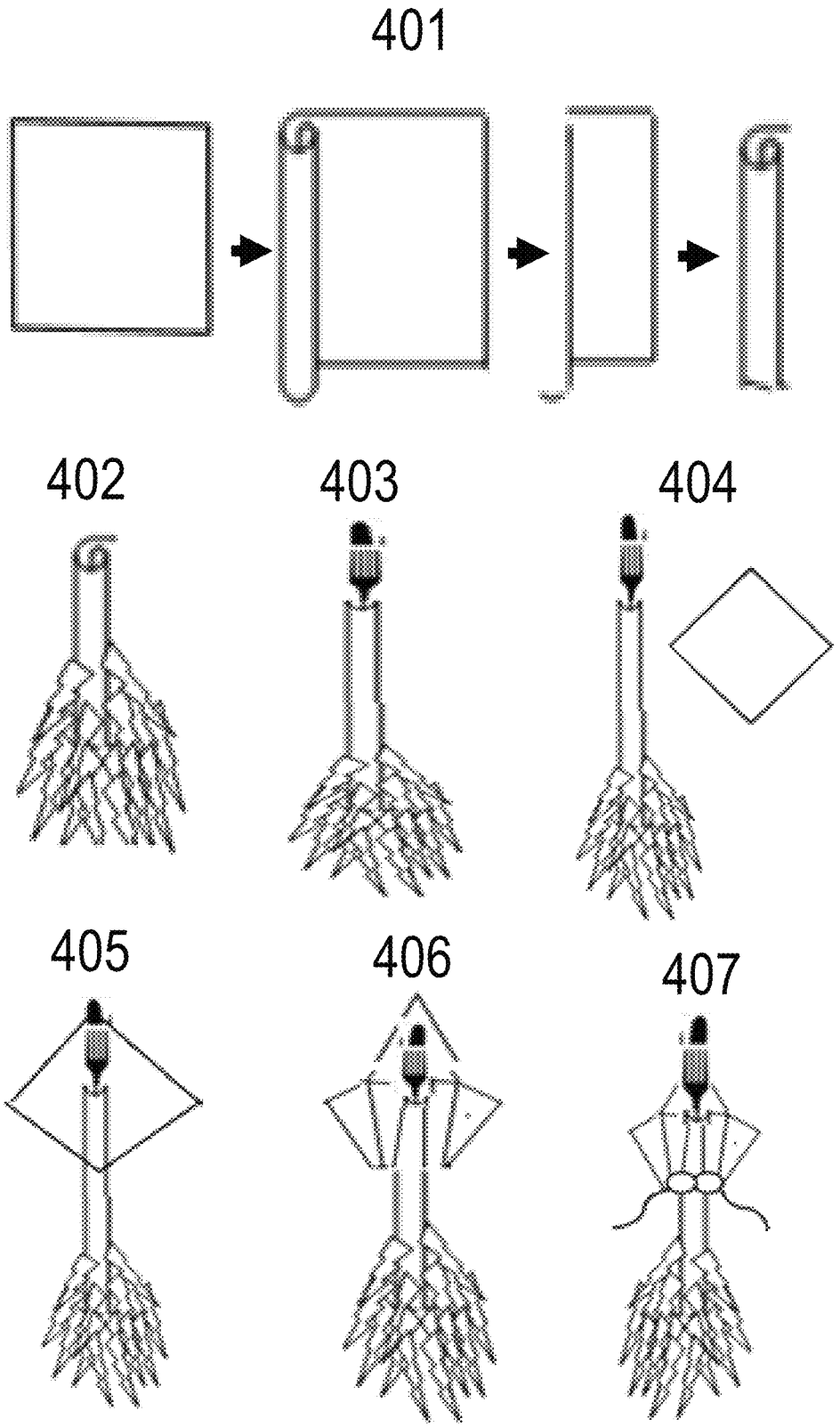
FIG. 4 is a schematic perspective view illustrating a sequence of napkin folds used to assemble another exemplary embodiment of a utensil holder.

Turning now to exemplary FIG. 4, a sequence of napkin folds used to assemble another exemplary embodiment of a utensil holder may be described. In accordance with the exemplary embodiment, reference numerals may depict: 401: providing a first napkin and rolling the first napkin into a tube configuration; 402: cutting one end of the tube configuration into elongated strips, wherein the cutting operation is provided by a pair of scissors and performed half way up the length of the tube; 403: positioning at least one utensil inside the tube configuration, wherein the at least one utensil enters the tube from the end opposite the cuts; 404: providing a second napkin in a diagonal manner; 405: positioning the tube configuration with the at least one utensil provided therein at a center surface of the second napkin; 406: folding the right side of the second napkin diagonally inward on a slant; and folding the left side of the second napkin diagonally inward on a slant; 407: pinching and securing the center of the napkins; securing a fastener, such as a ribbon, around the napkins; and tying the fastener into a bow to secure both napkins and the at least one utensil in place.

Figure 5:
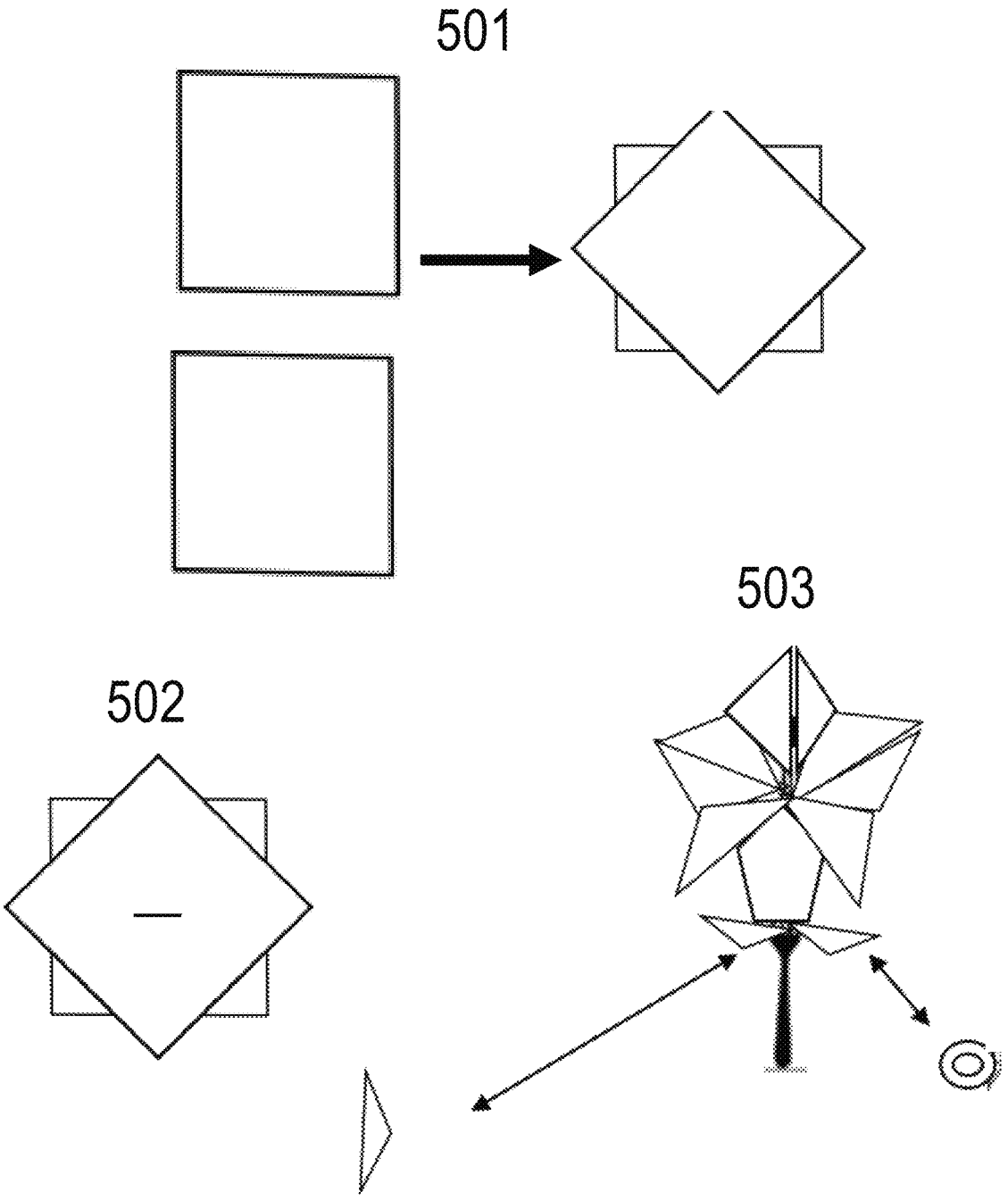
FIG. 5 is a schematic perspective view illustrating a sequence of napkin folds used to assemble another exemplary embodiment of a utensil holder.

Turning now to exemplary FIG. 5, a sequence of napkin folds used to assemble another exemplary embodiment of a utensil holder may be described. In accordance with the exemplary embodiment, reference numerals may depict: 501: providing two napkins, each napkin having a perimeter with four sides; overlapping the two napkins in a diagonal direction; 502: creating an aperture through a center portion of the overlapped napkins; 503: extending at least one utensil through the aperture to the neck thereof; the napkins may be pinched from the bottom, and folded in an upward twist-like motion around the utensils with a upward sweep. In some exemplary embodiments, a third napkin may be cut in half to resemble leaf-like protrusions, and an aperture created through a center portion may mount the third napkin with the other napkins over the at least one utensil. The third napkin may be pinched and secured with a fastening device, such as tape or a ribbon. An artificial light bulb may be positioned in the middle of the overlapped napkins.

Figure 6:
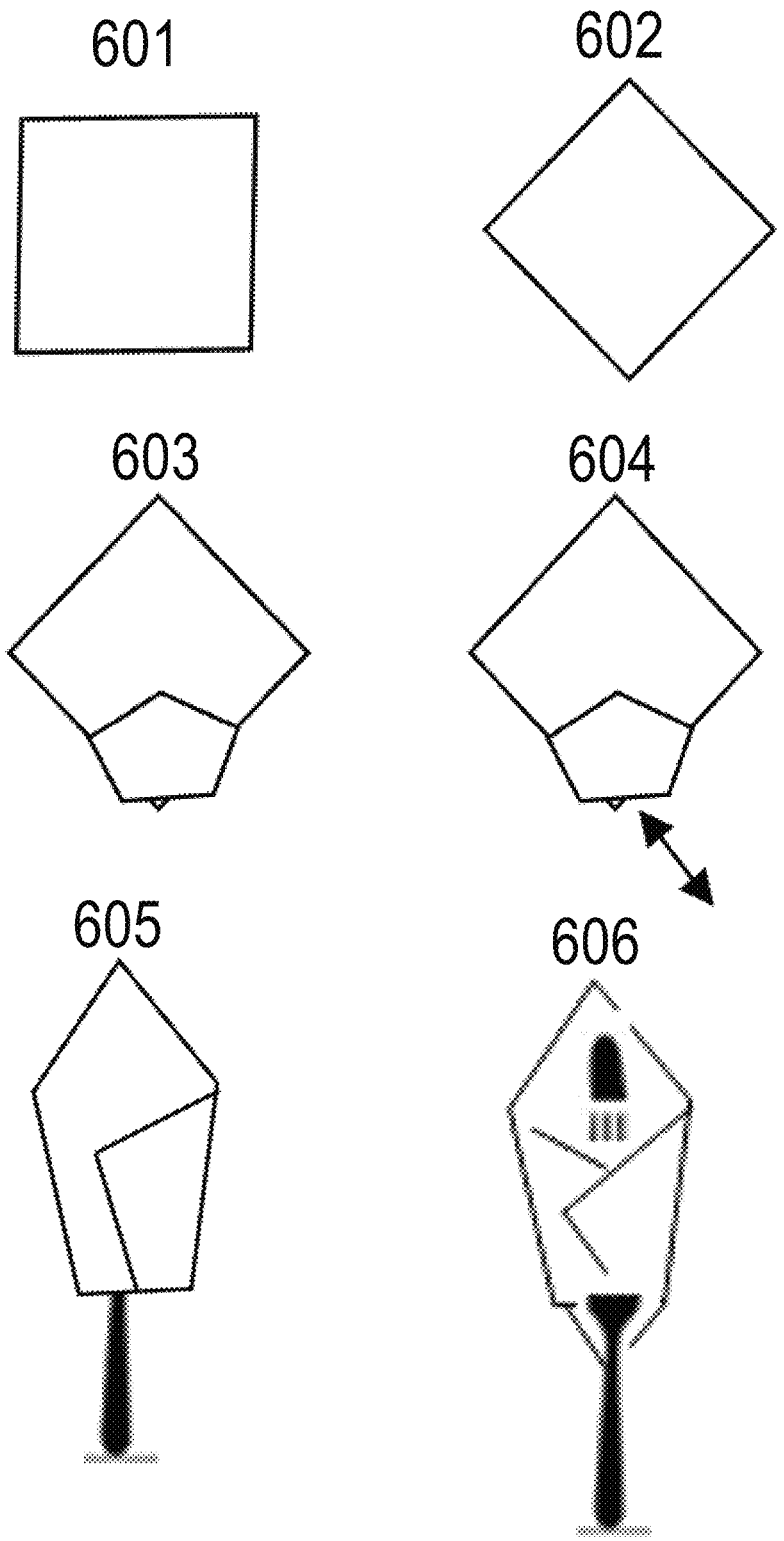
FIG. 6 is a schematic perspective view illustrating a sequence of napkin folds used to assemble another exemplary embodiment of a utensil holder.

Turning now to exemplary FIG. 6, a sequence of napkin folds used to assemble another exemplary embodiment of a utensil holder may be described. In accordance with the exemplary embodiment, reference numerals may depict: 601: providing a napkin, the napkin having a perimeter with four sides; 602: placing the napkin in a diagonal direction; 603: folding a bottom corner of the napkin toward the center thereof, the fold being approximately half way to the center; 604: unfolding the flap and cutting an aperture through the center of the fold crease, the aperture configured to receive at least one utensil therethrough; 605: positioning at least one utensil through the aperture, folding one corner of the napkin inward and across the at least one utensil; 606: folding the other corner of the napkin inward and across the at least one utensil thereby creating a cone. In some exemplary embodiments, a fastener, such as a piece of tape or ribbon, may be secured to a bottom portion of the napkin.

Figure 7:
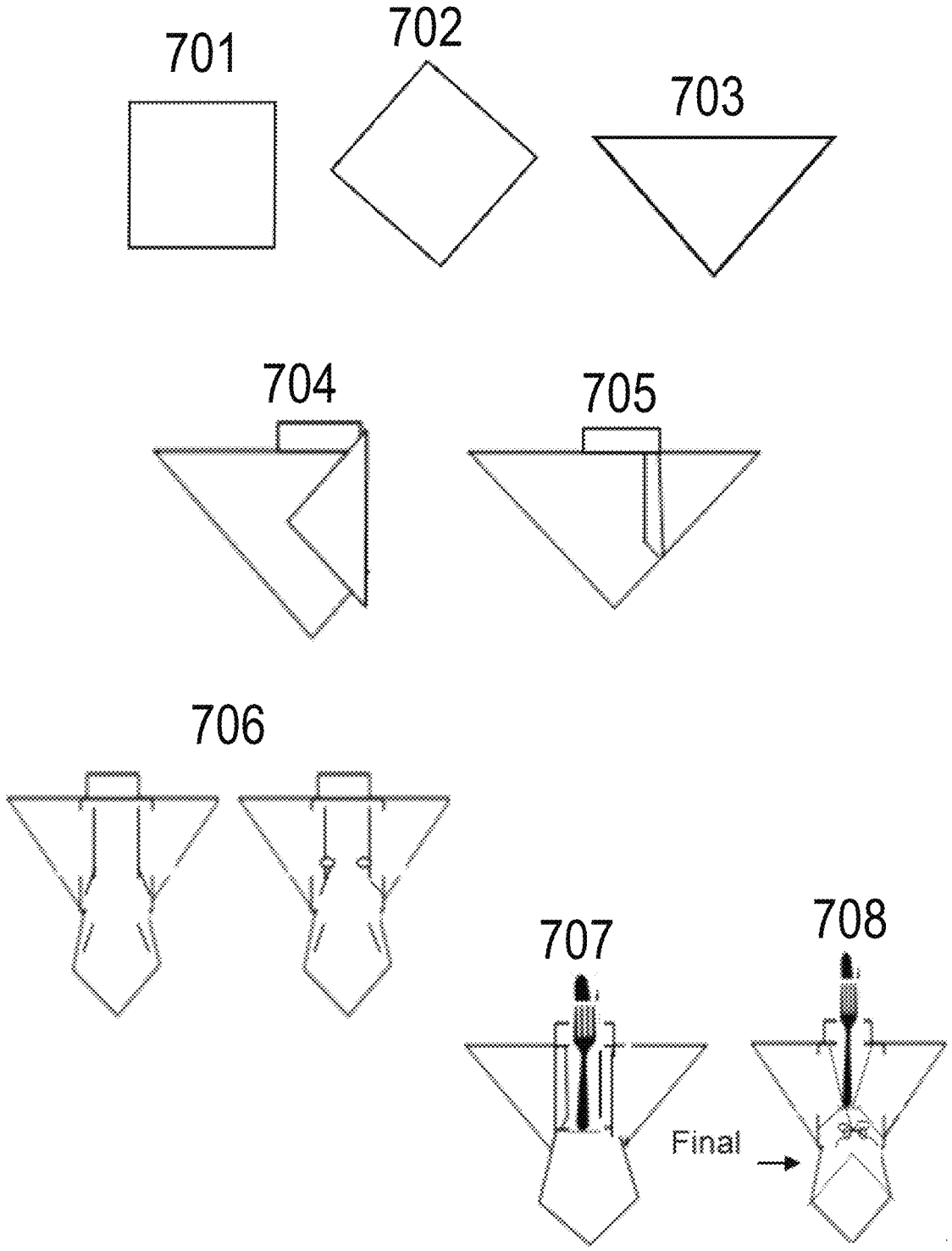
FIG. 7 is a schematic perspective view illustrating a sequence of napkin folds used to assemble another exemplary embodiment of a utensil holder.

Turning now to exemplary FIG. 7, a sequence of napkin folds used to assemble another exemplary embodiment of a utensil holder may be described. In accordance with the exemplary embodiment, reference numerals may depict: 701: providing a napkin, the napkin having a perimeter with four sides; 702: positioning the napkin in a diagonal direction; 703: folding the napkin downward in equal halves; 704: folding one corner of the napkin inward towards the other corner and with approximately one half of an inch, folding back the corner to leave a folded crease therein; 705: performing the same operation as in 704 to the other side of the napkin; 706: creating two apertures through a center portion of the napkin; 707: positioning at least one utensil in the center of the napkin; 708: securing the utensils with a fastener, such as a ribbon, threaded through the two apertures.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method of assembling a utensil holder, the method comprising:

providing two napkins, each napkin having a perimeter with four sides;

overlapping the two napkins in a diagonal direction such that a corner of a top napkin of the two napkins is situated on a center of a bottom napkin of the two napkins, the four sides of the top napkin being arranged parallel to the four sides of the bottom napkin;

positioning at least one utensil adjacent a center of the overlapped napkins, wherein the at least one utensil has a first end and a second end defining a longitudinal axis;

folding a left corner of the top napkin and a left corner of the bottom napkin toward the center of the overlapped napkins;

folding a right corner of the top napkin and a right corner of the bottom napkin toward the center of the overlapped napkins;

creating an aperture through the folded corners of the overlapped napkins; and threading a fastener through the aperture.

2. The method of claim 1, further comprising:

folding a portion of the bottom napkin over the at least one utensil to secure the at least one utensil in place.

3. The method of claim 1, wherein the fastener is a ribbon.

* * * * *